US005788520A

United States Patent [19]

Roche

[11] Patent Number: 5,788,520

[45] Date of Patent: Aug. 4, 1998

[54] CONNECTOR SHORTING BAR RETENTION

[75] Inventor: Michael J. Roche, Dearborn, Mich.

[73] Assignee: Osram Sylvania Inc., Danvers, Mass.

[21] Appl. No.: 779,067

[22] Filed: Jan. 7, 1997

[51] Int. Cl.[6] ..... H01R 29/00

[52] U.S. Cl. ..... 439/188; 200/51.1

[58] Field of Search ..... 439/188; 200/51.1, 200/51.12

[56] References Cited

U.S. PATENT DOCUMENTS

| | | | |
|---|---|---|---|
| 5,145,356 | 9/1992 | Minnis | 439/188 |
| 5,277,608 | 1/1994 | Oda | 439/188 |
| 5,370,543 | 12/1994 | Hamada et al. | 439/188 |
| 5,466,168 | 11/1995 | Liebich et al. | 439/188 |

*Primary Examiner*—Neil Abrams
*Assistant Examiner*—T. C. Patel
*Attorney, Agent, or Firm*—William H. McNeill

[57] ABSTRACT

A connector is provided which includes first and second insulative housings each of which includes first and second contacts, respectively, which may be electrically and mechanically connected and disconnected, in a connected mode and disconnected mode, respectively. The first insulative housing includes shorting bars which are spring biased into contact with the first contacts in the disconnected mode. The second insulative housing includes engagement posts which engage the shorting bars in a connected mode to disengage the shorting bars from the first contacts. An improved manner of mounting the shorting bars in the first insulative housing from the rear of such housing is provided. The shorting bars are firmly held in place by a primary retention and a secondary retention. The primary retention results from a press fit between a lower length of each shorting bar and a slot formed by opposing slot walls of the first insulative housing. The secondary retention results from the engagement of each shortage bar by a retention post extending into the rear of the first insulative housing from a rear cover.

20 Claims, 7 Drawing Sheets

CONNECTOR SHORTING BAR RETENTION

TECHNICAL FIELD

The present invention relates to a connector which includes a female connector housing having female contacts and a mating male connector housing having male contacts which may be electrically and mechanically connected together. Shorting bars are provided in one of the connector housings. The present invention particularly relates to the manner in which such shorting bars are mounted in a respective connector housing.

BACKGROUND ART

In fabricating electrical connectors, shorting bars are typically mounted in a respective connector housing from the front of the connector. The front of the connector is the engagement end; that is, the end at which contacts housed in one connector housing are inserted into mating contacts housed in another connector housing. Such front end loading facilitates sealing. However, there is a reduction in the amount of terminal stop which is achievable. In other words, when shorting bars are inserted in the engagement end of a first connector housing, there is a tendency for such shorting bars to be pushed out of position when the second connector housing is mated with the first. Such movement of a shorting bars is undesirable. For example, such movement alters the position of the shorting bars vis-a-vis the contacts which the shorting bars must engage, when the connector housings are disconnected, thereby adversely affecting the shorting function.

DISCLOSURE OF THE INVENTION

It is an object of the present invention to provide an improved connector.

It is another object of the present invention to provide a connector housing wherein shorting bars mounted therein are firmly held in place during the mating of a female connector housing with a male connector housing.

It is a further object of the present invention to provide primary retention and secondary retention of shorting bars in a connector housing.

Yet a further object of the present invention is to provide a connector housing wherein shorting bars are inserted therein from the rear of the housing.

This invention achieves these and other objects by providing a connector which comprises first and second slidably engaging housings which comprise mating contacts and mating shorting bar members. The first housing comprises at least one slot therein formed by opposing slot surfaces of the first housing. Each shorting bar member comprises a flexible conductive shorting bar positioned within the first housing and a mating engagement post extending from the second housing. Each shorting bar comprises at least one length which extends into, and forms an interference fit with, a slot. A cover is attached to a rear of the first housing, the cover comprising at least one retention post which extends into the first housing and engages the shorting bar.

BRIEF DESCRIPTION OF THE DRAWINGS

This invention may be clearly understood by reference to the attached drawings wherein like elements are designated by like reference numerals and in which.

BEST MODE FOR CARRYING OUT THE INVENTION

Figure 1:
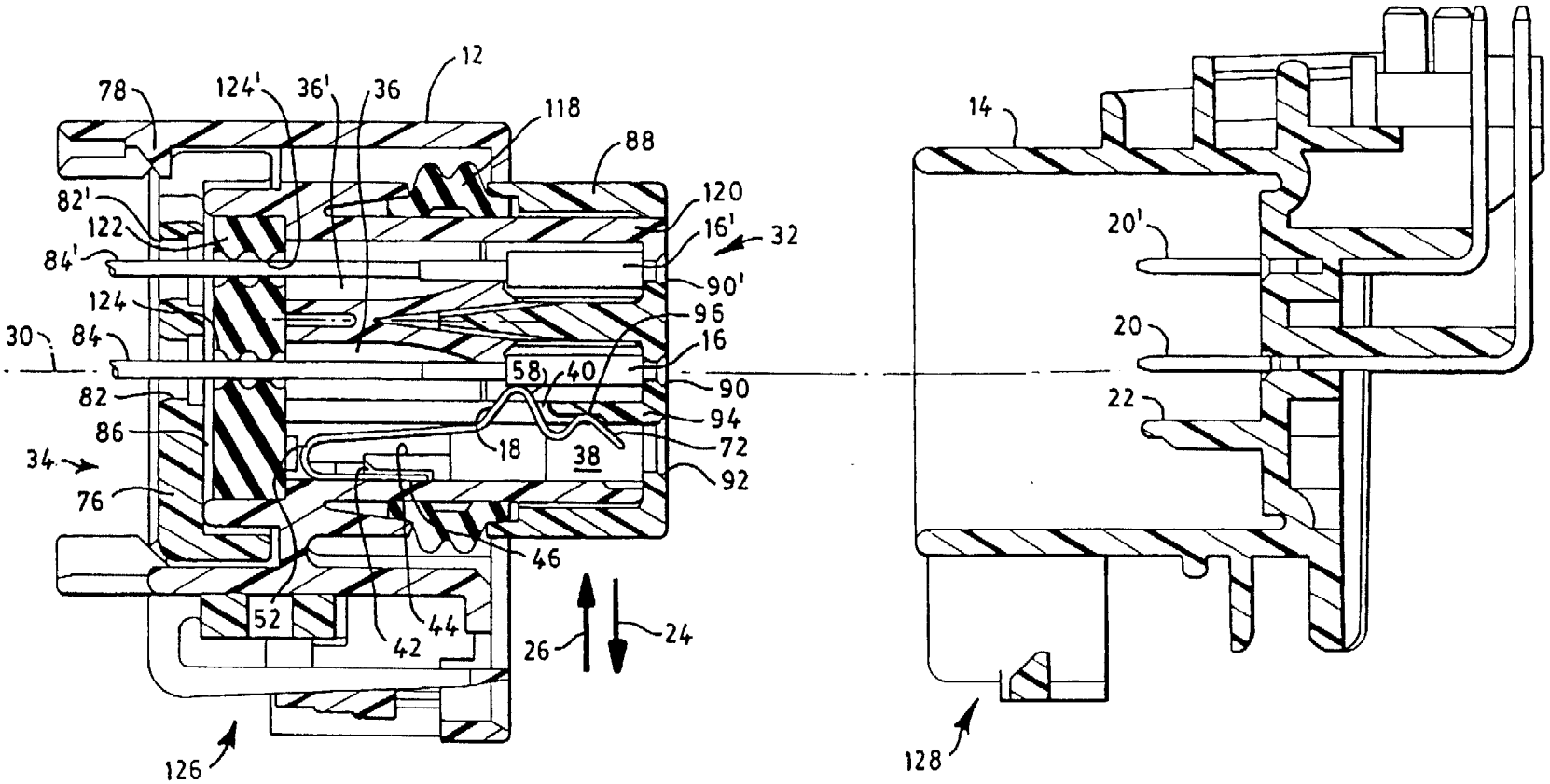
FIG. 1 is a cross section of FIGS. 2 and 8 embodying one form of the present invention, the first insulative housing 12 of FIG. 1 being a cross section of FIG. 2, with the cover 76 added for clarity, taken along lines 1—1 thereof, and the second insulative housing 14 of FIG. 1 being a cross section of FIG. 8 taken along lines 1—1 thereof.

For a better understanding of the present invention, together with other and further objects, advantages and capabilities thereof, reference is made to the following disclosure and appended claims taken in conjunction with the above-described drawings.

The embodiment of this invention which is illustrated in the drawings is particularly suited for achieving the objects of this invention. FIGS. 1 to 3 and 8 depict a connector 10 comprising a first insulative housing 12 and a second insulative housing 14. First insulative housing 12 comprises a plurality of first contacts 16 and a plurality of flexible shorting bars 18 engageable and disengageable relative to the plurality of first contacts 16 as described herein. By way of example, in the embodiment of FIGS. 1 to 3, the first contacts 16 are female contacts. The second insulative housing 14 comprises a plurality of second contacts 20 and a plurality of engagement posts 22. By way of example, in the embodiment of FIGS. 1 to 3 and 8, the second contacts 20 are male contacts. The second insulative housing 14 is adapted for connection with the first insulative housing 12. In particular, the first insulative housing 12 may be mated with the second insulative housing 14 in a connected mode by inserting the male contacts 20 into respective female contacts 16 to effect a mechanical and electrical connection therebetween. During such insertion, the engagement posts 22 are inserted into the first insulative housing 12 and engage the ends of respective shorting bars 18 to disengage the shorting bars from the contacts 16 by camming each shorting bar in the direction of arrow 24 away from a respective contact 16. The first insulative housing 12 may be separated from the second insulative housing 14, in a disconnected mode, by withdrawing the male contacts 20 from respective female contacts 16. During such withdrawal, the engagement posts 22 are withdrawn from the first insulative housing 12 and thereby disengage the ends of respective shorting bars 18 permitting each shorting bar to flex in the direction of arrow 26 into engagement with a respective contact 16.

Figure 2:
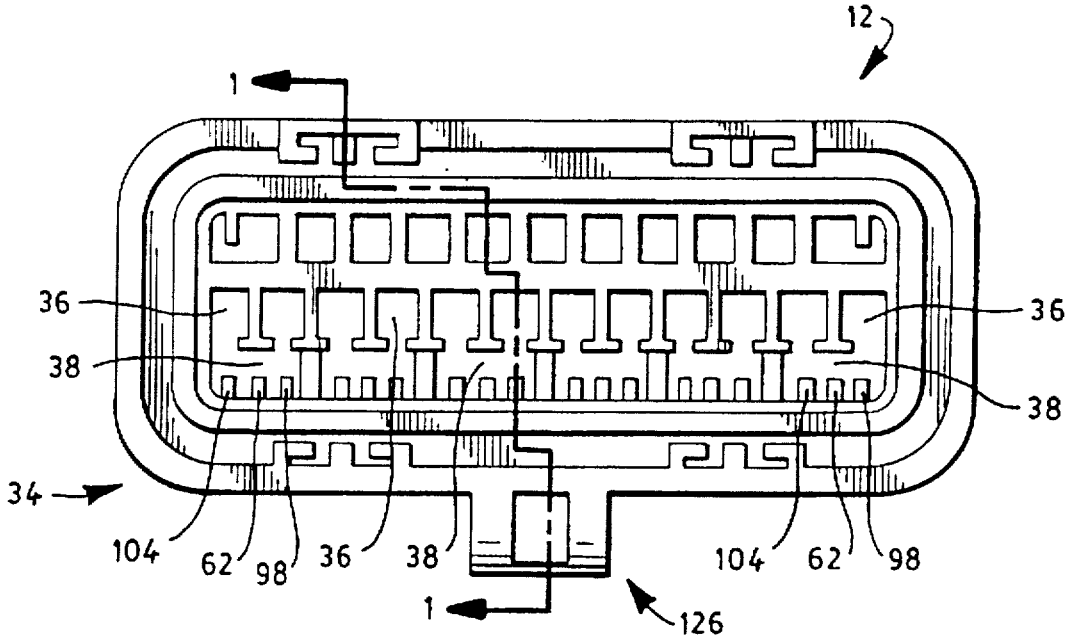
FIG. 2 is a rear view of the first insulative housing 12 of the present invention with the cover 76 removed for clarity.
Figure 3:
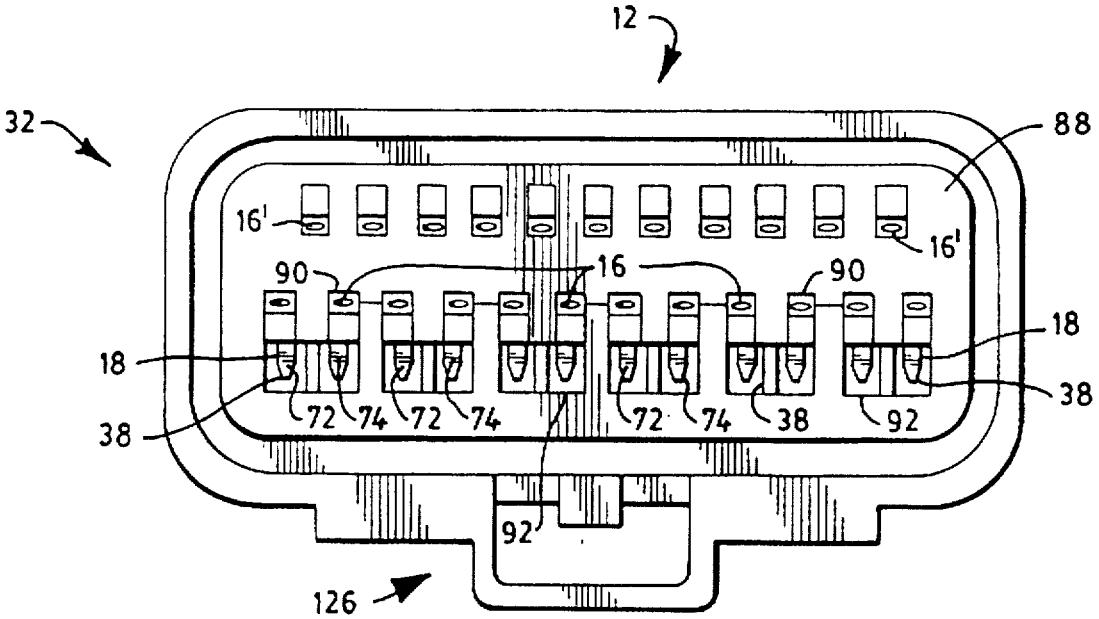
FIG. 3 is a front view of the first insulative housing 12.

The first insulative housing 12 extends in the direction 28 of a longitudinal axis 30 from a front 32 of the housing 12 to a rear 34. With reference to FIGS. 1, 2 and 3, first insulative housing 12 comprises a plurality of first apertures 36 which extend through the housing 12 in the direction 28, and a plurality of second apertures 38 which extend through housing 12 in the direction 28. Apertures 36 are parallel to apertures 38. Each aperture 36 is connected to an aperture 38 by an opening 40 which extends between apertures 36 and 38. A contact 16 extends in each aperture 36 from the front 32 towards the rear 34. Each aperture 38 includes therein at least one slot 42 formed by opposing slot surfaces 44 and 46 of the housing 12, slot 42 extending in the direction 28.

Figure 4:
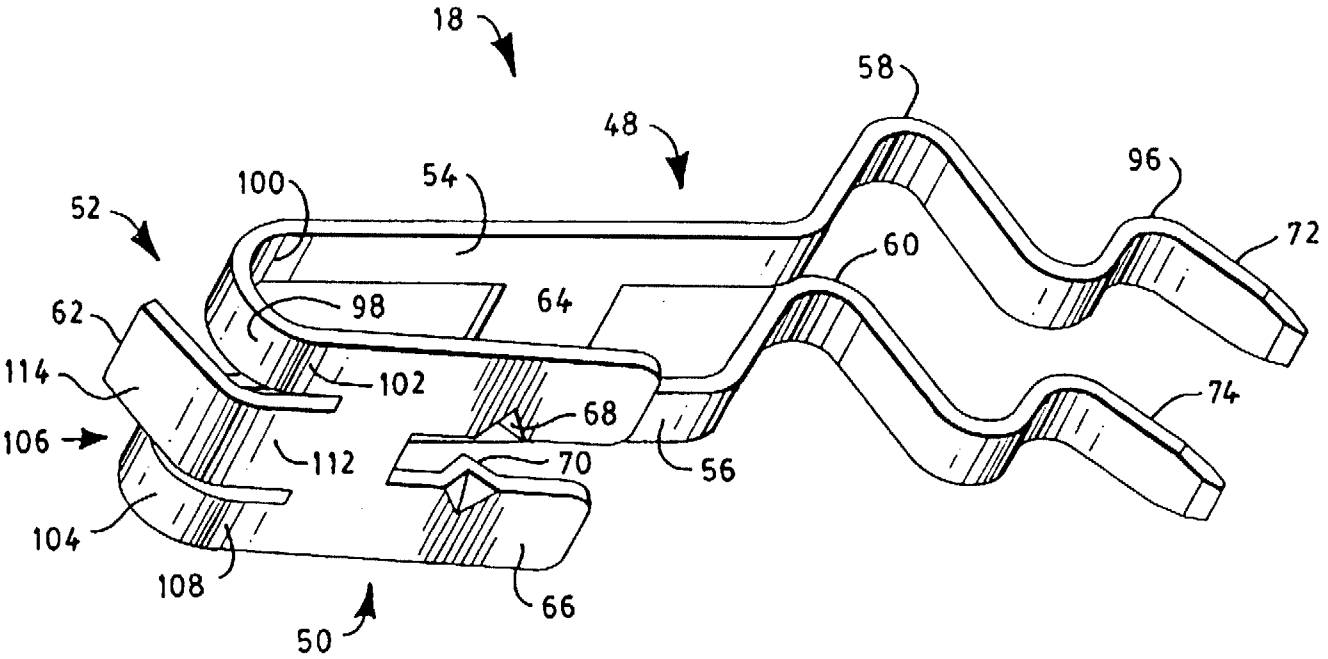
FIG. 4 is a perspective view of a shorting bar embodying one form of the present invention.

A detailed configuration of a preferred shorting bar 18 is depicted in FIG. 4. Shorting bar 18 comprises an upper length 48 and a lower length 50 joined together by a connecting length 52, the upper length being flexible relative to the lower length. The upper length of the shorting bar of the present invention comprises at least one protruding contact surface and at least one engagement surface. In the embodiment of FIG. 4, the shorting bar 18 comprises two protruding contact surfaces and two engagement surfaces. In particular, the upper length 48 comprises a first leg 54 and a second leg 56 each of which extends from the connecting length 52. Leg 54 includes a first protruding contact surface 58, and leg 56 includes a second protruding contact surface 60. In the preferred embodiment, the lower length 50 includes a tab 62 extending from the lower length adjacent the connecting length 52. In the preferred embodiment, tab 62 is flexible. In the preferred embodiment, the lower length of the shorting bar of the present invention also includes at least one detent. In the embodiment of FIG. 4, the shorting bar 18 comprises two detents. In particular, the lower length 50 comprises a first arm 64 and a second arm 66 each of which extends from the connecting length 52. Arm 64 includes a first detent 68 which protrudes from arm 64 towards the upper length 48. Similarly, arm 66 includes a second detent 70 which protrudes from arm 66 towards upper length 48. The shorting bar of the present invention also includes at least one engagement surface. In the embodiment of FIG. 2, the shorting bar 18 comprises two engagement surfaces. In particular, leg 54 comprises a first engagement surface 72 at a distal end of leg 54, and leg 56 comprises a second engagement surface 74 at a distal end of leg 56.

Each shorting bar 18 extends into a respective second aperture 38 in such a manner that the upper length 48 and lower length 50 extend from the connecting length 52 towards the front 32 of the insulative connector 12. The lower length 50 extends into, and forms an interference fit with, a slot 42 to facilitate holding the shorting bar in place relative to the insulative housing 12. In the preferred embodiment, the detents 68 and 70 facilitate such interference fit by frictionally engaging the surface 44 of a slot 42. The protruding contact surface 58 extends through an opening 40 into a first aperture 36, the flexible tab 62 extends towards the rear 34 of the insulative housing 12, and the engagement surface 72 extends towards the front 32 of the insulative housing 12.

Figure 6:
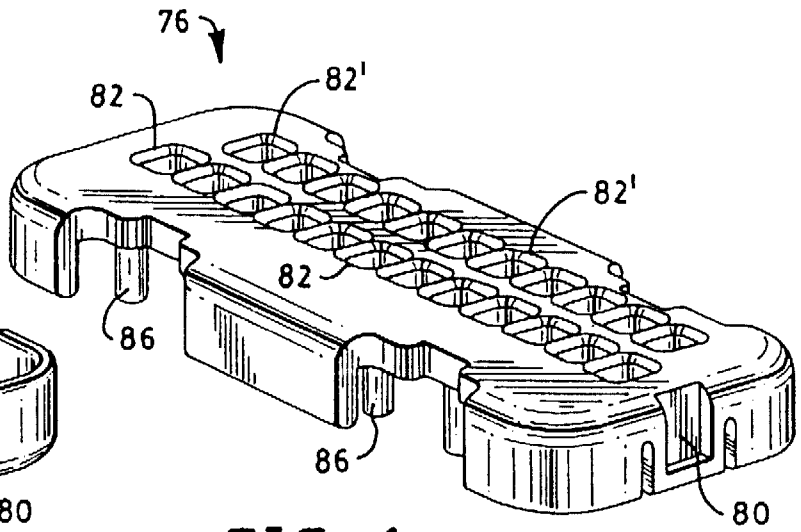
FIG. 6 is a perspective view showing the front of the cover of FIG. 5.
Figure 5:
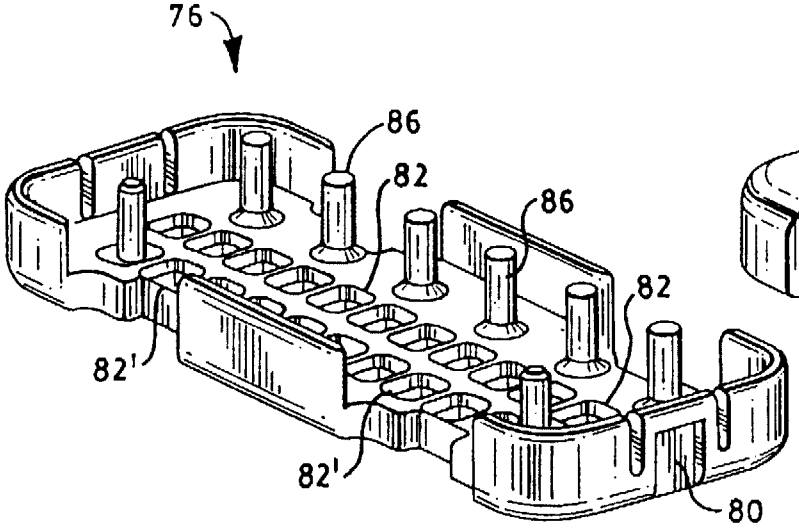
FIG. 5 is a perspective view showing the rear of a cover embodying one form of the present invention.

The connector 10 comprises a cover 76 as depicted in FIGS. 1, 5 and 6. Cover 76, which is depicted in detail in FIGS. 5 and 6, is attached to the rear 34 of the insulative housing 12 by snap members 78 of insulative housing 12 associated with mating snap members 80 of the cover. Cover 76 comprises a plurality of first holes 82 which are aligned with the plurality of first apertures 36 at the rear 34 of the insulative housing 12. A conductor 84, extends through each of the first holes 82, into a first aperture 36, and is electrically and mechanically connected to a contact 16 in a conventional manner as, for example, by soldering or welding. An inner surface of the cover 76 comprises a plurality of retention posts, each of which engages a respective shorting bar. For example, in the embodiment of FIG. 5, a plurality of retention posts 86 extend from an inner surface of cover 76. Each post 86 is aligned with and extends into a respective second aperture 38 and engages a flexible tab 62 of a respective shorting bar 18. In the preferred embodiment, each retention post 86 and each flexible tab 62 are dimensioned such that when the cover 76 is snap-fitted onto the rear of the insulative housing 12, the retention post 86 will deflect the flexible tab 62 causing it to bend towards the front 32 of the insulative housing.

Connector 10 comprises a spacer 88 attached to the front 32 of the insulative housing 12 in a conventional manner such as by snap members (not shown) similar to snap members 78 and 80. As depicted in FIGS. 1 and 3, the spacer 88 comprises a plurality of first spacer holes 90 which extend therethrough and are aligned with the plurality of first apertures 36 at the front 32 of the insulative housing 12. Spacer 88 also includes a plurality of second spacer holes 92 which are aligned with the plurality of second apertures 38. A plurality of retaining lengths 94 extend in the direction 28 of longitudinal axis 30 toward the rear 34 of the insulative housing 12 and are formed as a part thereof. Each retaining length 94 is aligned with a respective second aperture 38 and extends into such aperture 38 such that when assembled, a retaining length engages a shorting bar 18 adjacent an engagement surface 72 or 74. For example, in the embodiment of FIG. 1, a retaining length 94 extends into a second aperture 38 and engages the shorting bar 18 at surface 96 which is adjacent an engagement surface 72.

Figure 7A:
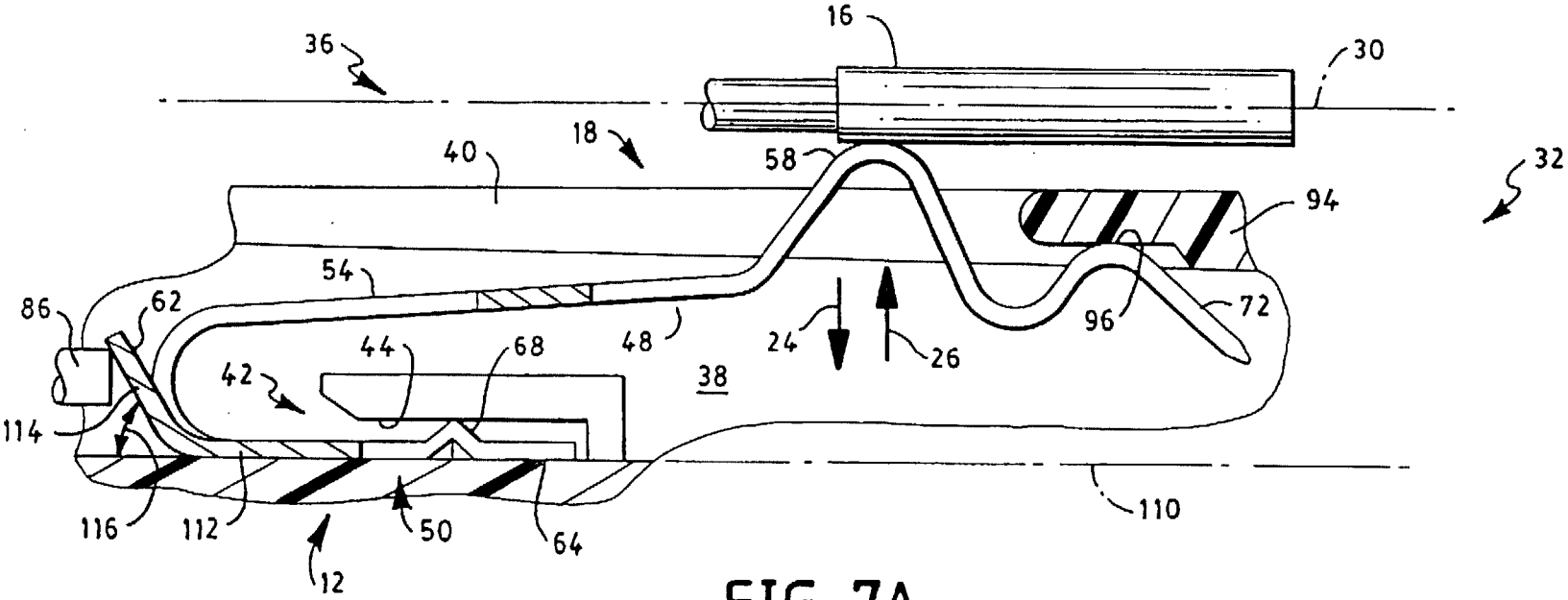
FIG. 7A is a cross sectional partial diagrammatic representation of the shorting bar of FIG. 4 assembled within the first insulative housing 12 of FIG. 1, in a disconnected mode.

In assembling the connector 10, each shorting bar 18 is inserted into a respective aperture 38 from the rear 34 depicted in FIGS. 1 and 2 before the cover 76 is attached to such housing. As each shorting bar is so inserted from the rear 34, the arms 64 and 66 of the lower length 50 enter a respective slot 42, and each protruding contact surface 58 and 60 extends through an opening 40 and into an aperture 36 for engagement with a respective contact 16. This is depicted in FIG. 7A regarding arm 64 and protruding contact surface 58. In this manner, detents 68 and 70 will provide primary retention by effecting an interference fit between the arms 64 and 66 and a slot surface 44 of a respective slot 42. This is depicted in FIG. 7A with respect to detent 68. The cover 76 will then be snapped into place on the rear 34 of the insulative housing 12 causing each retention post 86 to engage and deflect a respective flexible tab 62 as depicted in FIG. 7A to provide secondary retention to further retain each shorting bar firmly in place.

Figure 7B:
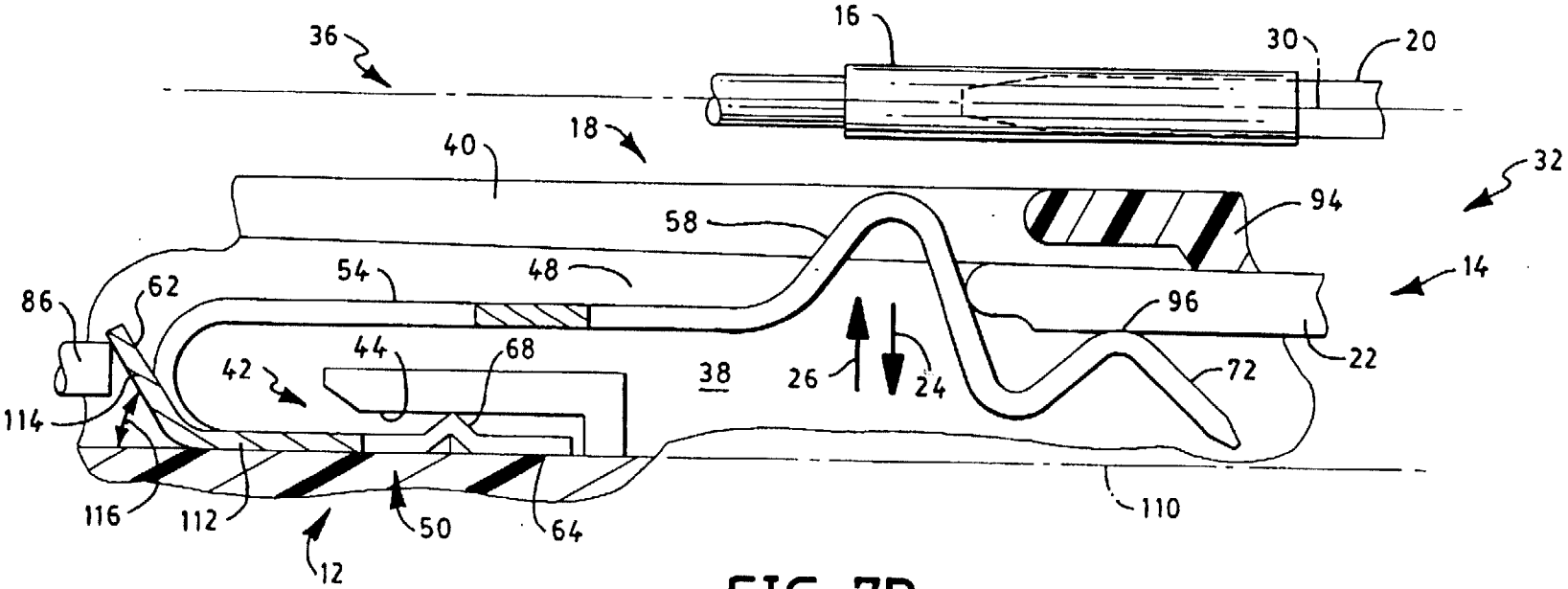
FIG. 7B is a cross sectional partial diagrammatic representation of the shorting bar of FIG. 4 assembled within the first insulative housing 12 of FIG. 1, in a connected mode.
Figure 8:
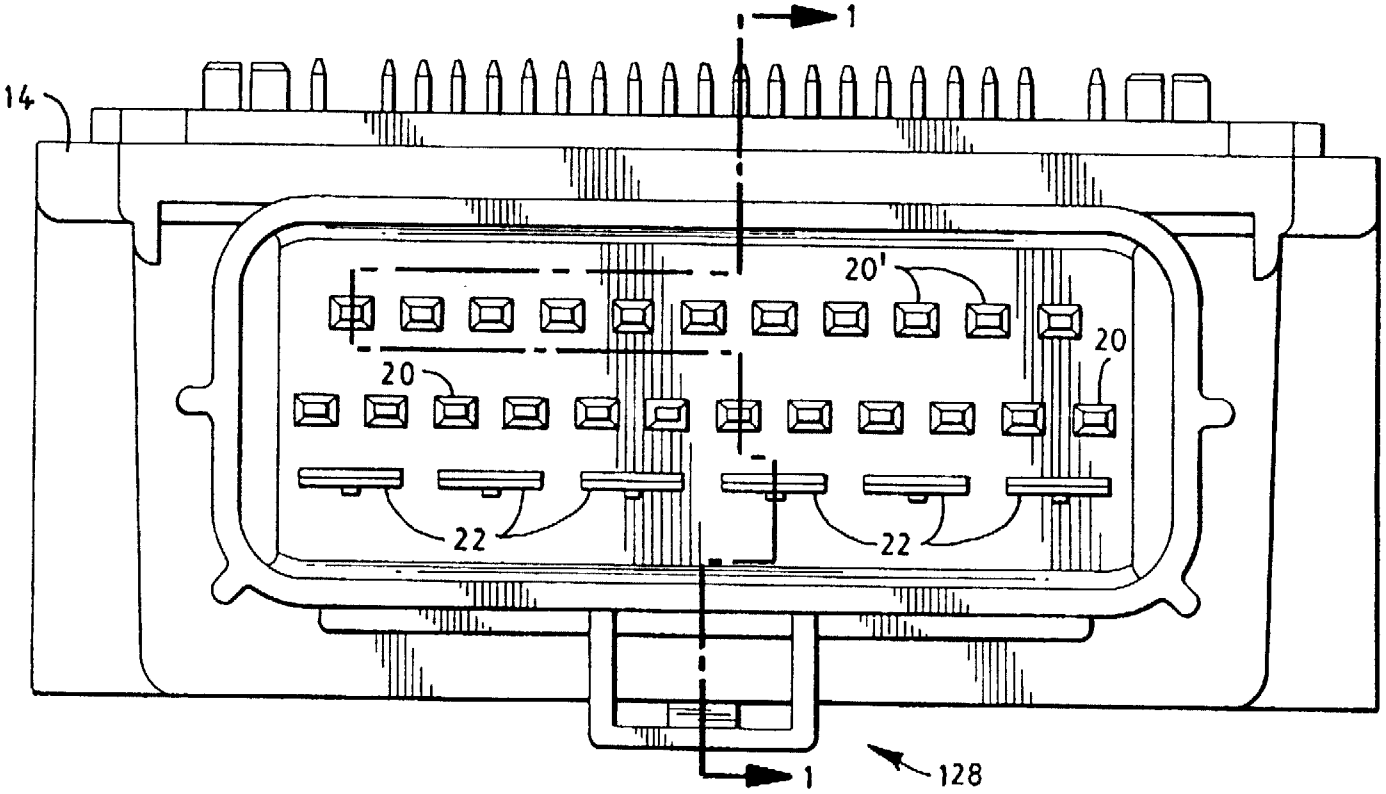
FIG. 8 is a front view of the second insulative housing 14 of FIG. 1.

In considering the use of the connector 10, FIGS. 1 and 7A depict the connector in a disconnected mode. It will be noted that the upper length 48 of the conductive shorting bar 18 is flexibly biased away from the lower length 50 such that the protruding contact surface 58 is urged into electrical contact with the female contact 16 to short the connector in the usual manner. FIG. 7B depicts the connector 10 in a connected mode. In particular, the second insulative housing 14 has been electrically and mechanically connected to the first insulative housing 12 by inserting each male contact 20 into a first aperture 38 in such a manner that the male contact 20 is inserted into the female contact 16 in a conventional manner. During this operation, the engagement post 22 is simultaneously inserted into the second aperture 38, engages the engagement surface 72 and cams the protruding contact surface 58 downward in the direction of arrow 24 to disengage the protruding contact surface from the female contact 16 as the engagement post slides into contact with surface 96 of the shorting bar 18. Such movement of the shorting bar 18 eliminates the shorting caused by the previous engagement of the protruding contact surface 58 with the female contact 16. The connector 10 is now electrically and mechanically connected and fully operational.

In effecting such connector it will be noted that the shorting bar 18 will not be pushed out of the second aperture 38, or otherwise moved, towards the rear 34 of the insulative housing 12 as the male contact 20 is inserted into the female contact 16 and the engagement post 22 engages the engagement surface 72 to cam surface 58 downward. In particular, with reference to FIG. 7B, the shorting bar 18 is held in place longitudinally by the interference fit between the slot 42 and the arm 64 which provides primary retention of the shorting bar relative to the insulative housing 12. Such interference fit is facilitated by means of the detent 68 which bears against and bites into the slot surface 44. In addition, the retention post 86 bears against the tab 62 to provide secondary retention of the shorting bar 18 by urging the shorting bar towards the front 32 of the insulative housing 12; that is, in a direction which urges the shorting bar against the force of the male contact 20 and the engagement post 22 as the male contact and engagement post are being inserted into the insulative housing 12.

In the preferred embodiment, the shorting bar 18 is configured as depicted in FIG. 4. In particular, shorting bar 18 comprises a radiused connecting first segment 98 extending from end 100 to end 102 and a radiused connecting second segment 104 extending from a similar end 106 (not visible) to end 108. In such embodiment, when installed in the insulative housing 12, the leg 54, leg 56, arm 64 and arm 66 will each extend towards the front 32 of the insulative housing from ends 100, 106, 102 and 108, respectively. In the embodiment of FIG. 4, the flexible tab 62 extends from the lower length 50 at a position between the arm 64 and the arm 66. To facilitate the flexing of the tab 62 by the retention post 86, in the preferred embodiment the tab 62 extends at an angle relative to the lower length 50. For example, with reference to FIGS. 4 and 7A, the lower length 50 of the shorting bar 18 extends in a plane designated by line 110 (FIG. 7A) which is parallel to horizontal axis 30. Flexible tab 62 comprises a first tab length 112 which extends from the lower length 50 in plane 110 and a second tab length 114 which extends from the first tab length 112 at an angle 116 relative to the plane 110 and towards the longitudinal axis 30.

In some applications, it is desired to seal the connector 10, and to this end a seal 118 may be provided between the insulative housing 12 and the spacer 88 as depicted in FIG. 1. Seal 118 extends completely around the periphery of the wall 120 which encloses the apertures 36 and 38 as depicted in FIG. 1.

In addition, a grommet 122 may be provided between the insulative housing 12 and the cover 76. Grommet 122 comprises a plurality of grommet bores 124 which are aligned with the plurality of first apertures 36 such that a respective conductor 84 may extend out of the insulative housing 12, each conductor 84 being sealingly engaged by the grommet.

In the embodiment of FIGS. 1–3 and 8, the first insulative housing 12 may comprise a plurality of third contacts such as female contacts 16', and the second insulative housing 14 may comprise a plurality of fourth contacts such as male contacts 20'. Contacts 16'and 20'are connected or disconnected in the connected mode or disconnected mode, respectively, in the same manner described herein regarding the contacts 16 and 20. In such an embodiment, the cover 76 comprises a plurality of third holes 82'aligned with a plurality of third apertures 36'. Each aperture 36'extends in the direction 28 of longitudinal axis 30 and has a contact 16'extending therein. A conductor 84'extends through each of the third holes 82', into a third aperture 36', and is electrically and mechanically connected to a contact 16'in a conventional manner as, for example, by soldering or welding. In such embodiment, the spacer 88 will comprise a plurality of third spacer holes 90'extending therethrough which are aligned with the plurality of third apertures 36'to facilitate the insertion of male contacts 20'into female contacts 16'. Further, the grommet 122 will comprise a plurality of additional grommet bores 124'through which conductors 84'will extend.

Fabrication of the various components described herein may be accomplished using conventional procedures. For example, the insulative housings, cover and spacer may each be molded from a plastic material, such as, without limitation, nylon or polypropylene. The contacts and the shorting bars, may be stamped from a metal sheet and then rolled and/or bent as required to form the desired configuration. The insulative housings 12 and 14 may be of the type described in U.S. Pat. No. 5,370,550. In particular housings 12 and 14 may have a lock disabler as described in such patent. The two lock portions of such a lock disabler are depicted diagrammatically in the drawings at 126 and 128.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector comprising: first and second slidably engaging housings, said first housing comprising contacts and said second housing comprising mating contacts, said first housing comprising at least one slot therein formed by opposing slot surfaces of said first housing; and shorting bar members, each shorting bar member comprising a flexible conductive shorting bar within said first housing; at least one engagement post extending from said second housing, said at least one engagement post engaging at least one shorting bar of said shorting bar members and separating said at least one shorting bar from said contact; each shorting bar comprising at least one length which extends into, and forms an interference fit with, a slot of said at least one slot; and a cover attached to a rear of said first housing, said cover comprising at least one retention post which extends into said first housing and engages at least one shorting bar of said shorting bar members.

2. The connector of claim 1 wherein said shorting bar comprises a tab extending therefrom towards said rear, a retention post engaging said tab.

3. The connector of claim 2 wherein said at least one length comprises at least one detent which engages a surface of said slot to provide said interference fit.

4. The connector of claim 3 wherein said tab is flexible.

5. The connector of claim 1 wherein said shorting bar comprises an upper length joined to a lower length by a connecting length, said upper length comprising a first leg and a second leg each of which extends from a connecting length towards a front of said first housing.

6. The connector of claim 1 wherein said shorting bar comprises an upper length joined to a lower length by a connecting length, said lower length comprising a first arm and a second arm each of which extends from said connecting length towards a front of said first housing, said first arm extending into, and forming a first interference fit with, a first slot of said at least one slot, and said second arm extending into, and forming a second interference fit with, a second slot of said at least one slot.

7. The connector of claim 5 wherein said lower length comprises a first arm and a second arm each of which extends from said connecting length towards said front, said first arm extending into, and forming a first interference fit with, a first slot of said at least one slot, and said second arm extending into, and forming a second interference fit with, a second slot of said at least one slot.

8. The connector of claim 7 wherein said connecting length comprises a radiused connecting first segment extending from one first segment end to another first segment end, and a radiused connecting second segment extending from one second segment end to another second segment end, said first leg and said second leg extending from said one first segment end and said one second segment end, respectively, and said first arm and said second arm extending from said another first segment end and said another second segment end respectively.

9. The connector of claim 8 wherein said shorting bar comprises a tab extending from said lower length towards said rear and adjacent said connecting length, said retention post engaging said tab.

10. The connector of claim 9 wherein said first arm comprises a first detent which engages a surface of said first slot to provide said first interference fit, and further wherein said second arm comprises a second detent which engages a surface of said second slot to provide said second interference fit.

11. The connector of claim 10 wherein said tab is flexible.

12. The connector of claim 11 wherein said flexible tab extends from said lower length at a position between said first arm and said second arm.

13. The connector of claim 12 wherein said lower length extends in a plane which is parallel to a longitudinal axis of said first housing, and said flexible tab comprises a first tab length which extends from said lower length in said plane and a second tab length which extends from said first tab length at an angle relative to said plane and towards said longitudinal axis.

14. The connector of claim 1, further comprising a spacer attached to a front of said first insulative housing, said spacer comprising retaining lengths extending towards said rear from an inner surface of said spacer, respective retaining lengths engaging respective shorting bars.

15. The connector of claim 14 further comprising a seal positioned between said first housing and said spacer and a grommet positioned between said first housing and said cover.

16. A connector, comprising:

a first insulative housing comprising a plurality of first contacts and a plurality of flexible conductive shorting bars, said plurality of shorting bars being engageable and disengageable relative to said plurality of first contacts, and a second insulative housing comprising a plurality of second contacts and a plurality of engagement posts, said second insulative housing adapted for connection to said first insulative housing in a connected mode and disconnection from said first insulative housing in a disconnected mode, said plurality of first contacts being electrically and mechanically connected to said plurality of second contacts, and said plurality of engagement posts engaging said plurality of shorting bars to disengage said plurality of shorting bars from said plurality of first contacts, in said connected mode, and said plurality of first contacts being disconnected from said plurality of second contacts, and said plurality of engagement posts being disengaged from said plurality of shorting bars to permit said plurality of shorting bars to flex into engagement with said plurality of first contacts, in said disconnected mode, said first insulative housing extending in the direction of a longitudinal axis from a front to a rear and comprising a plurality of first apertures extending through said first insulative housing in said direction and a plurality of second apertures extending through said first insulative housing in said direction, said plurality of first apertures being parallel with said plurality of second apertures, each first aperture of said plurality of first apertures being connected by a respective opening to a second aperture of said plurality of second apertures, each first aperture comprising a first contact of said plurality of first contacts, each second aperture comprising at least one slot formed by opposing slot surfaces, said at least one slot extending in said direction, each shorting bar of said plurality of shorting bars comprising:

an upper length and a lower length joined together by a connecting length, said upper length having at least one protruding contact surface and at least one engagement surface, and being flexible relative to said lower length, said shorting bar extending into a respective second aperture such that (a) said lower length extends into, and forms an interference fit with, said at least one slot of said respective second aperture, (b) said at least one protruding contact surface extends through an opening into a first aperture, and (c) said at least one engagement surface extends towards said front; and a cover attached to said first insulative housing at said rear, said cover comprising a plurality of first holes aligned with said plurality of first apertures, and a plurality of retention posts, each retention post of said plurality of retention posts aligned with and extending in the direction of a respective second aperture and engaging a respective shorting bar.

17. The connector of claim 16 wherein said upper length of said shorting bar comprises a first leg and a second leg each of which extends from said connecting length towards said front, wherein said at least one protruding contact surface includes a first protruding contact surface protruding through a first opening into one first aperture, and a second protruding contact surface protruding through a second opening into another first aperture.

18. The connector of claim 17 wherein said lower length of said shorting bar comprises a first arm and a second arm each of which extends from said connecting length towards said front, said first arm extending into, and forming a first interference fit with, a first slot of said at least one slot, and said second arm extending into, and forming a second interference fit with, a second slot of said at least one slot.

19. The connector of claim 18 wherein said shorting bar comprises a flexible tab extending from said lower length towards said rear and adjacent said connecting length, said retention post engaging said flexible tab.

20. The connector of claim 19 wherein said first arm comprises a first detent which engages a surface of an opposing slot surface of said first slot to provide said first interference fit, and further wherein said second arm comprises a second detent which engages a surface of an opposing slot surface of said second slot to provide said second interference fit.

* * * * *